US010962002B2

(12) United States Patent
Fratini et al.

(10) Patent No.: US 10,962,002 B2
(45) Date of Patent: Mar. 30, 2021

(54) MULTI-PHASE PUMP WITH COOLED LIQUID RESERVOIR

(71) Applicant: Flowserve Management Company, Irving, TX (US)

(72) Inventors: Alejandro Fratini, Buena Park, CA (US); Jelenko Krsmanovic, Kitchener (CA); Carlos Reyes, Los Angeles, CA (US); William Tang, Villa Park, CA (US)

(73) Assignee: Flowserve Management Company, Irving, TX (US)

( * ) Notice: Subject to any disclaimer, the term of this patent is extended or adjusted under 35 U.S.C. 154(b) by 253 days.

(21) Appl. No.: 15/772,157

(22) PCT Filed: Nov. 1, 2016

(86) PCT No.: PCT/US2016/059904
§ 371 (c)(1),
(2) Date: Apr. 30, 2018

(87) PCT Pub. No.: WO2017/079155
PCT Pub. Date: May 11, 2017

(65) Prior Publication Data

US 2018/0320685 A1 Nov. 8, 2018

Related U.S. Application Data

(60) Provisional application No. 62/249,487, filed on Nov. 2, 2015.

(51) Int. Cl.
*F04C 2/16* (2006.01)
*F04C 15/00* (2006.01)
(Continued)

(52) U.S. Cl.
CPC ..... *F04C 2/16* (2013.01); *F04C 13/001* (2013.01); *F04C 13/004* (2013.01);
(Continued)

(58) Field of Classification Search
CPC .. F04C 2/084; F04C 2/088; F04C 2/16; F04C 13/001; F04C 13/004; F04C 15/0019;
(Continued)

(56) References Cited

U.S. PATENT DOCUMENTS 5,795,135 A 8/1998 Nyilas et al.
5,871,340 A * 2/1999 Hatton ..... E21B 43/00 417/377

(Continued)

FOREIGN PATENT DOCUMENTS

WO 2007140151 A2 12/2007

OTHER PUBLICATIONS

Flowserve MP1 Brochure, flowserve-twin-screw-mp1 (Year: 2006).*

(Continued)

*Primary Examiner* — Devon C Kramer
*Assistant Examiner* — David N Brandt
(74) *Attorney, Agent, or Firm* — Maine Cemota & Rardin

(57) ABSTRACT

Overheating of a process liquid retained in a reservoir of a multiphase pump during extended gas slugs is avoided by circulating a cooling liquid in thermal contact with a process liquid through an external cooling apparatus, which can include a heat exchanger. In some embodiments, process liquid from the reservoir is circulated through the cooling loop, while in other embodiments a separate cooling liquid is circulated between a reservoir heat exchanger and the external cooling apparatus. The liquid in the cooling loop can be circulated by a separate cooling pump, or process liquid can be circulated through the cooling loop due to a pressure differential between an inlet and an outlet of the (Continued)

cooling loop within the multiphase pump. The multiphase pump can be a twin screw pump, and the reservoir can be formed between outer and inner casings of the multiphase pump.

10 Claims, 3 Drawing Sheets

(51) Int. Cl.
*F04C 13/00* (2006.01)
*F04C 2/08* (2006.01)
*F04C 19/00* (2006.01)

(52) U.S. Cl.
CPC ..... *F04C 15/0096* (2013.01); *F04C 2/084* (2013.01); *F04C 2/088* (2013.01); *F04C 15/0019* (2013.01); *F04C 15/0026* (2013.01); *F04C 19/007* (2013.01); *F04C 2210/24* (2013.01)

(58) Field of Classification Search
CPC ..... F04C 15/0026; F04C 15/0096; F04C 19/0007; F04C 19/042; F04C 2210/24
See application file for complete search history.

(56) References Cited

U.S. PATENT DOCUMENTS

| | | | | |
|---|---|---|---|---|
| 6,135,723 | A | 10/2000 | Hatton | |
| 6,241,486 | B1 * | 6/2001 | Sloteman ..... | F04C 13/00 417/370 |
| 2009/0098003 | A1 | 4/2009 | Kothnur et al. | |
| 2015/0226214 | A1 * | 8/2015 | Rohlfing ..... | F04C 15/06 418/1 |

OTHER PUBLICATIONS

International Search Report & Written Opinion for Appl PCT/US2016/059904 dated Feb. 7, 2017, 10 pages.
International Preliminary Report on Patentability for Appl PCT/US2016/059904 dated May 8, 2018, 9 pages.
Drillingforumals.com, "Basic Knowledge of Multiphase Pumping for Subsea Operation", Brochure, Aug. 20, 2016, 7 pages. Grapevine, Texas, USA.
Flowserve, "MP1 Multiphase Twin-Screw Pump", Bulletin PS-60-2 (E), Jun. 2006, 8 Pages, Flowserve Corporation, Irving, Texas, USA.

* cited by examiner

MULTI-PHASE PUMP WITH COOLED LIQUID RESERVOIR

RELATED APPLICATIONS

This application is a national phase application filed under 35 USC § 371 of PCT Application No. PCT/US2016/059904 with an International filing date of Nov. 1, 2016 which claims the benefit of U.S. Provisional Application No. 62/249,487, filed Nov. 2, 2015. Each of these applications is herein incorporated by reference in its entirety for all purposes.

FIELD OF THE INVENTION

The invention relates to pumps, and more particularly, to multi-phase pumps.

BACKGROUND OF THE INVENTION

Multiphase pumps, in particular pumps that are applicable for pumping a process fluid that is a mixture of liquid and gas, have gained increased acceptance in oil field production and other applications, where they have replaced conventional production equipment with simpler and more economical technology. Multiphase pumping helps to eliminate separators, compressors, individual pumping equipment, heaters, gas flares and separate flow lines, thereby improving production at lower costs.

An additional benefit of multiphase pumps in the oil industry is the reduced environmental impact for onshore installations. Multiphase pumps require only a fraction of the space that is occupied by conventional pumping apparatus, and the ability of multiphase pumps to handle gas in a closed system instead of venting and flaring the gas guarantees low emissions and thereby protects the environment.

In order to maintain internal sealing for the compression of the gas phase, a small quantity of liquid must be provided during the entire operation of a multiphase pump. This can be achieved by either an internal system which tolerates short gas slugs only, or by using external liquid separators or scrubbers to collect liquid downstream of the pumps, run it through a heat exchanger to reduce the temperature of the liquid and re-inject such liquid back to the suction upstream of the pump, thereby tolerating much longer gas slugs.

In particular, some twin screw multiphase pump designs incorporate a reservoir chamber between the outer and inner casings of the pump which acts as a liquid trap that captures process liquid and uses the pump discharge pressure to re-inject the liquid into the screw inlets via internal ports. This feature ensures that enough liquid is contained and maintained inside of the pump so that when there is no liquid entering the unit through the incoming process stream, the gas can continue to be compressed by allowing the trapped liquid to act as a hydraulic seal along the clearance between screws and bores to maintain independence of the locks or closed chambers formed by the screws and casing bores. With this feature, some twin screw multiphase pump designs are capable of pumping and compressing any combination of liquid and gas, from 0% gas to 100% gas.

Heat is unavoidably generated in a multiphase pump due to the inherent heat of gas compression. When there is relatively little gas in the process stream, so that the gas slugs are relatively short, the gas compression heat is easily absorbed into the process liquid and transported away from the pump. For a twin screw or other multiphase pump that maintains a reservoir of liquid, relatively longer gas slugs can be tolerated, because the heat of gas compression is absorbed by the liquid reservoir. However, when the process stream consists mostly of gas, and the gas slugs are consequently very long, a liquid reservoir can become overheated, so that it becomes too hot to efficiently cool the gas, or evaporates out of the casing and/or flows out of the casing due to a drag effect until there is insufficient liquid remaining in the casing to absorb the heat. As a result, the temperature of the discharge stream can rise until it exceeds an acceptable limit.

What is needed, therefore, is a multiphase pump design that can tolerate very long gas slugs without overheating.

SUMMARY OF THE INVENTION

A multiphase pump includes a reservoir of process liquid that is cooled by a heat exchanger or other cooling apparatus, so that very long gas slugs can be tolerated without overheating of the liquid in the reservoir and without an unacceptable rise in the temperature of the discharge stream.

In various embodiments, liquid from the reservoir is extracted from the chamber and passed through a cooling loop that includes a heat exchanger or other cooling device before being reinjected into the reservoir. In some of these embodiments, the liquid is circulated through the cooling loop by means of a separate cooling pump that can be upstream or downstream of the heat exchanger. Some of these embodiments further include a pressure regulating valve. Other of these embodiments do not include a separate cooling pump. Instead, the outlet of the cooling loop is placed within a suction chamber of the multiphase pump, so that the suction created by the multiphase pump causes the liquid to be drawn from the reservoir, which is at the higher discharge pressure, through the cooling loop to the suction chamber, which is at the lower inlet pressure.

In other embodiments, the reservoir liquid is cooled by circulating a separate cooling fluid through a heat exchanger that is in thermal communication with the reservoir.

In embodiments, the pump is a twin screw multiphase pump, and in some of these embodiments the reservoir chamber is formed between outer and inner casings of the pump, whereby the reservoir chamber acts as a liquid trap that captures process liquid and uses the pump discharge pressure to re-inject the captured liquid into the screw inlets via internal ports.

By cooling the liquid inside of the reservoir, the present invention avoids any need for an additional separator outside of the pump and ensures a more efficient extraction of heat than if the cooled liquid was removed downstream of the pump and re-injected upstream of the pump.

The present invention is a multiphase pump configured to pump a process fluid having liquid and gas components from an inlet to an outlet. The multiphase pump includes a liquid reservoir configured to retain process liquid extracted from the process fluid as it flows through the multiphase pump, and to communicate the retained process liquid to an inlet region of the multiphase pump during gas slugs, thereby ensuring that a gas seal is maintained within the pump, and a cooling loop in thermal communication with the process liquid in the reservoir and configured to remove heat from the process liquid in the reservoir by circulating a cooling liquid between the reservoir and a cooling apparatus that is exterior to the reservoir.

In some embodiments, the cooling loop is in fluid communication with the process liquid retained in the reservoir, and the cooling liquid circulated through the cooling loop is process liquid extracted from and returned to the reservoir. And in some of these embodiments a liquid outlet of the cooling loop is located in a region of the multiphase pump that is at a pressure lower than a pressure of the process liquid retained in the reservoir, so that a pressure difference between the cooling loop outlet and a cooling loop inlet causes process liquid to flow through the cooling loop. In other embodiments the cooling loop includes a heat exchanger contained within the reservoir and configured to exchange heat between the process liquid retained in the reservoir and the cooling liquid circulated through the cooling loop.

In any preceding embodiment where the process liquid is not caused to flow through the cooling loop by a pressure difference between the cooling loop outlet and a cooling loop inlet, the cooling loop can further includes a cooling pump configured to circulate the cooling liquid through the cooling loop.

In any preceding embodiment, the cooling loop can further include a cooling liquid pressure control valve, and/or the cooling apparatus can be a heat exchanger.

In any preceding embodiment, the multiphase pump can be a twin screw pump, and/or the reservoir can be a chamber formed between an outer casing of the multiphase pump and an inner casing of the multiphase pump.

And in any preceding embodiment the reservoir can be configured to retain liquid from the process fluid by functioning as a liquid trap that captures process liquid from the process fluid as the process fluid flows through the multiphase pump.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
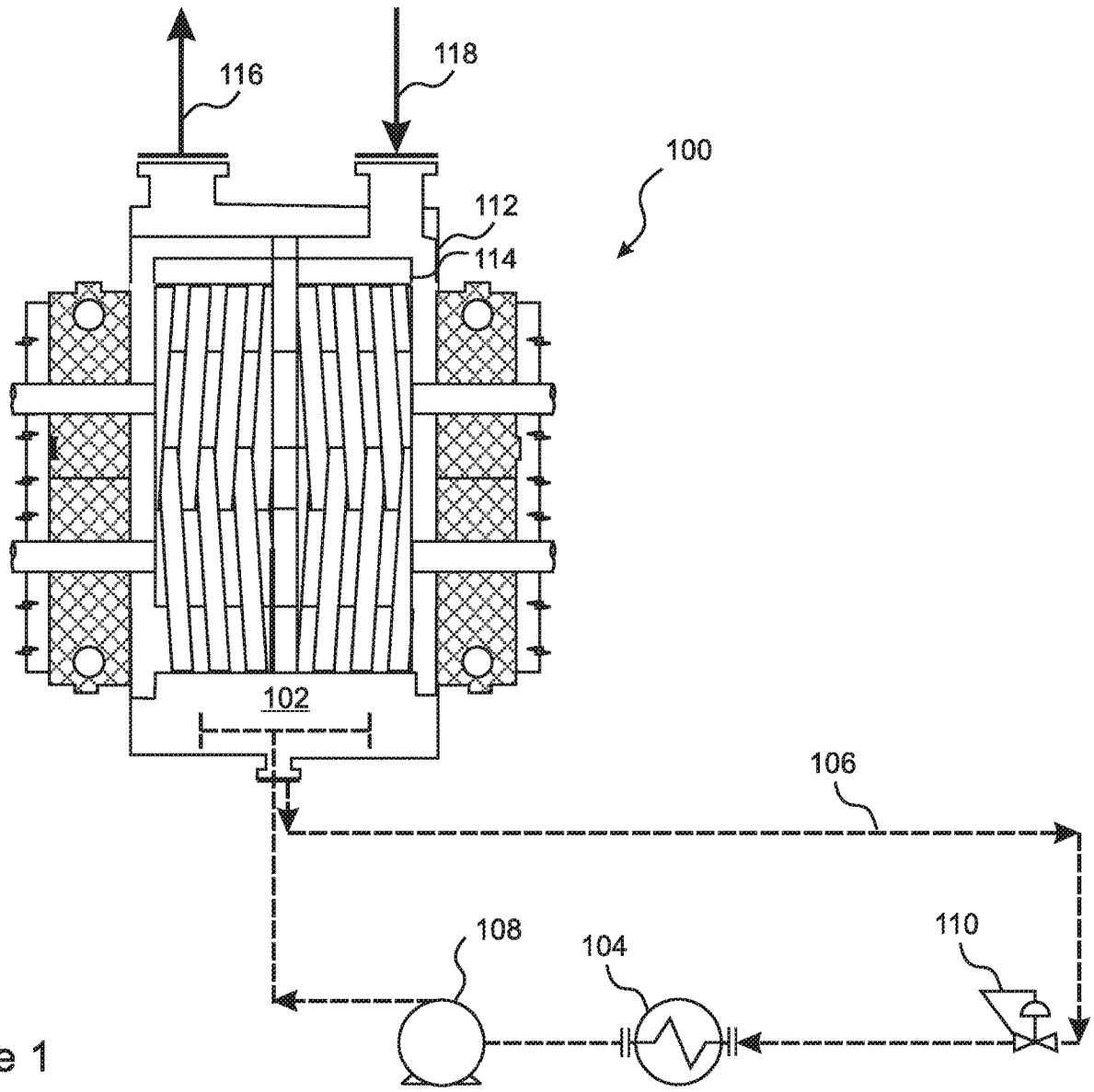
FIG. 1 is an illustration of an embodiment in which process liquid is circulated from the pump reservoir through the cooling loop by a separate cooling pump.

With reference to FIG. 1, the present invention is a multiphase pump 100 that is configured to pump a process fluid having liquid and gas components from an inlet 118 to an outlet 116. The multiphase pump 100 includes a reservoir 102 of liquid which is cooled by a heat exchanger 104 or other cooling mechanism, so that very long gas slugs can be tolerated without overheating of the liquid in the reservoir 102 and without an unacceptable rise in the temperature of the discharge stream 116.

In the embodiment of FIG. 1, a reservoir 102 formed between the outer 112 and inner 114 casings of the multiphase pump 100 functions as a liquid trap that collects process liquid. To ensure that the trapped liquid is available inside the bores of the pump 100 where the compression takes place, calibrated orifices are provided that communicate liquid from the reservoir 102, which is at a higher discharge pressure, to the suction area of the inner casing 114 of the pump 100.

To avoid overheating of the liquid in the reservoir 102, in the embodiment of FIG. 1 some of the liquid is extracted from the reservoir 102 and passed through a cooling loop 106 that includes a heat exchanger 104. In the embodiment of FIG. 1, the liquid is circulated through the cooling loop 106 by a separate cooling pump 108 that is downstream of the heat exchanger 104. In similar embodiments, the cooling pump is upstream of the heat exchanger 104. The embodiment of FIG. 1 further includes a pressure regulating control valve 110 that regulates the pressure and flow of the liquid through the cooling loop 106.

Figure 2:
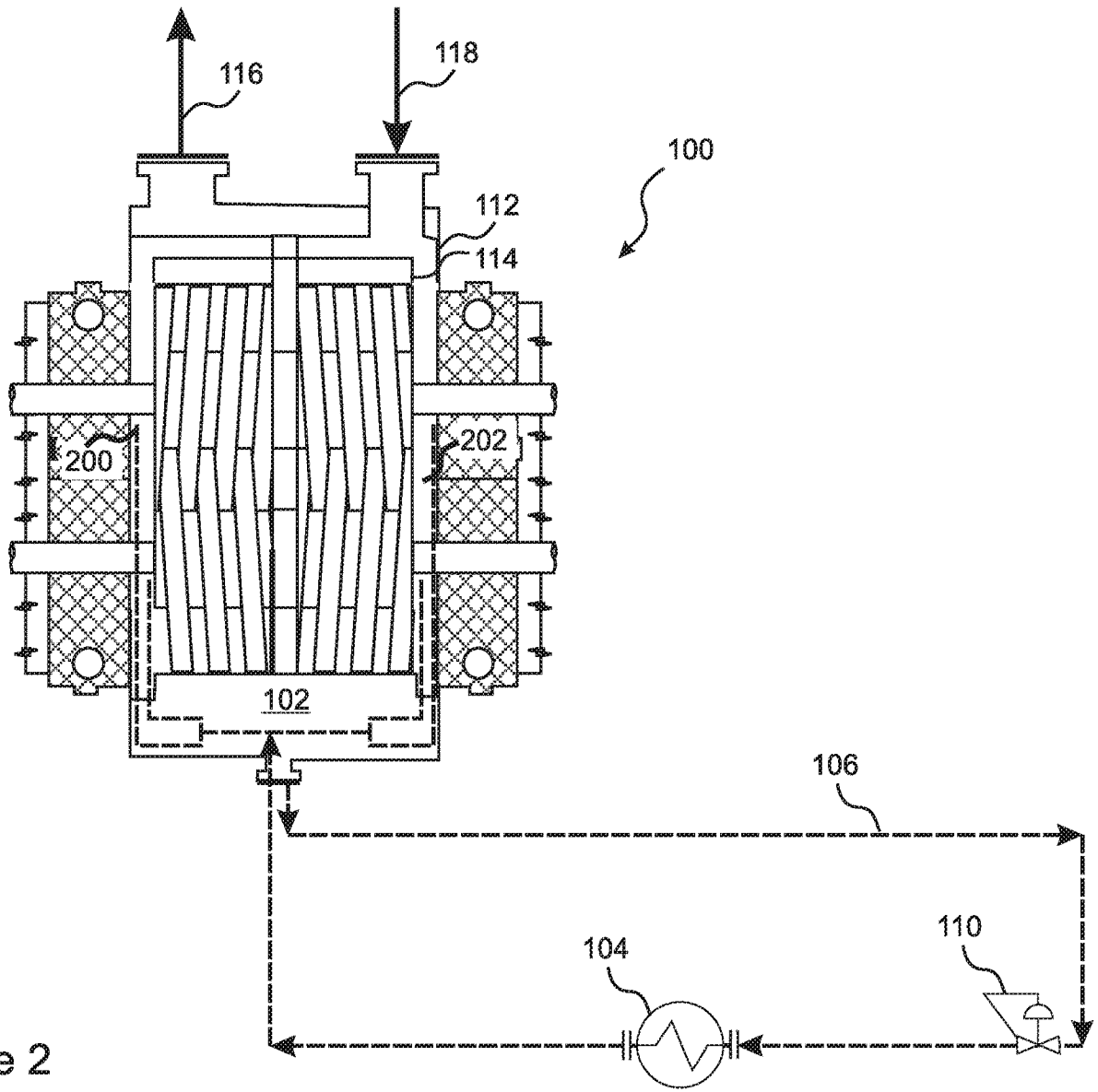
FIG. 2 is an illustration of an embodiment similar to FIG. 1, except that circulation of the process liquid through the cooling loop is induced by a pressure difference within the multiphase pump between an inlet and an outlet of the cooling loop.

FIG. 2 illustrates an embodiment similar to FIG. 1, but in which the liquid from the reservoir 102 is caused to flow through the cooling loop 106 without the need of a separate cooling pump 108. Instead, the outlet 200 of the cooling loop 106 is placed within a suction chamber 202 of the multiphase pump 100, so that the suction created by the multiphase pump 100 causes the liquid to be drawn from the reservoir 102, which is at the higher discharge pressure, through the cooling loop 106 to the suction chamber 202, which is at the lower inlet pressure.

Figure 3:
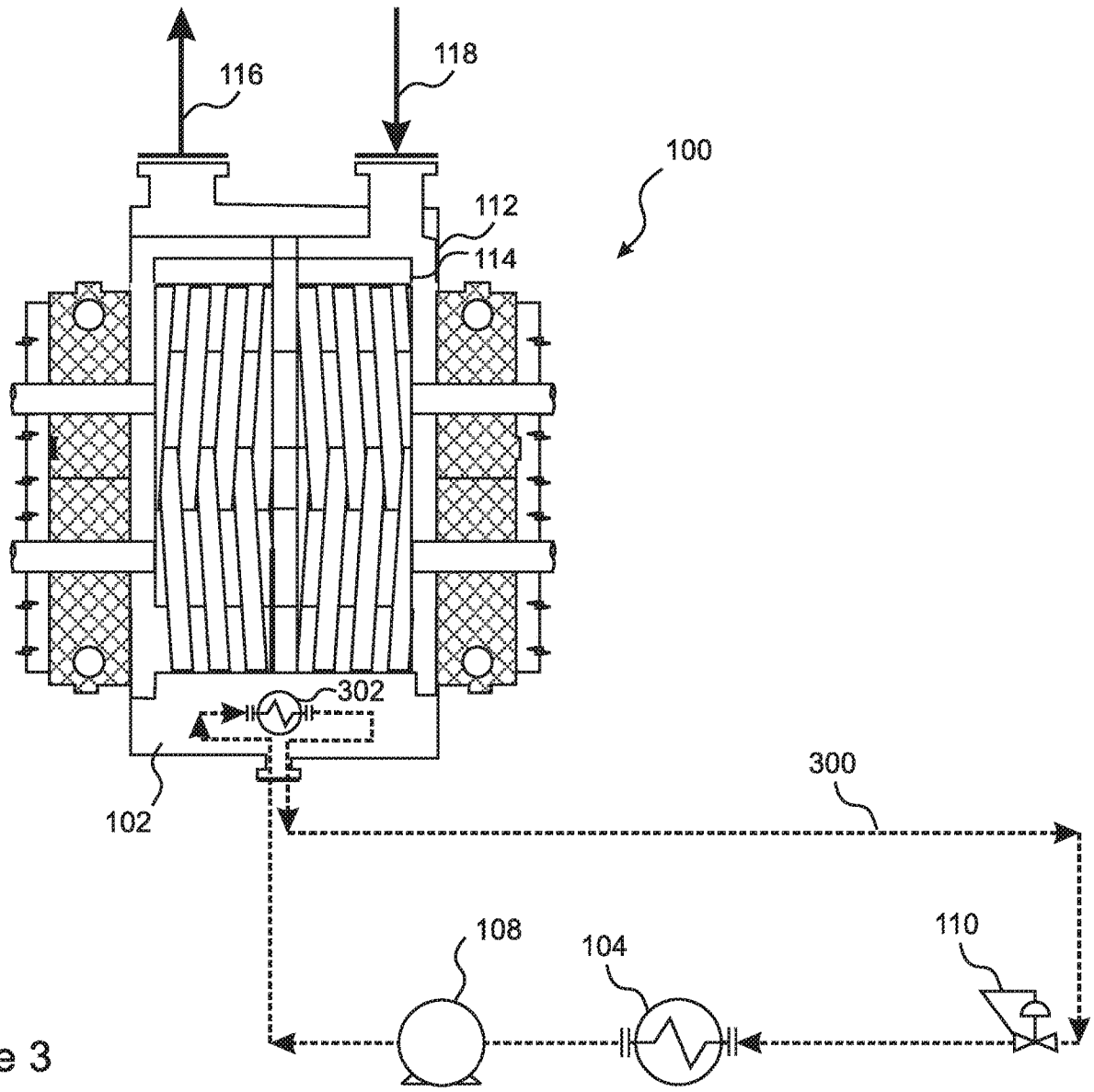
FIG. 3 is an illustration of an embodiment in which a separate cooling liquid is circulated through a heat exchanger within the reservoir.

With reference to FIG. 3, in other embodiments the process liquid in the reservoir 102 is cooled by circulating a separate cooling fluid 300 through a heat exchanger 302 that is in thermal communication with the reservoir.

Note that, by cooling the liquid inside of the reservoir 102, the present invention avoids any need for an additional separator outside of the pump 100, and thereby ensures a more efficient extraction of heat than if the cooled liquid was removed downstream of the pump 100 and re-injected upstream of the pump 100.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

This specification is not intended to be exhaustive. Although the present application is shown in a limited number of forms, the scope of the invention is not limited to just these forms, but is amenable to various changes and modifications without departing from the spirit thereof. One or ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

We claim:

1. A multiphase pump configured to pump a process fluid having liquid and gas components from an inlet to an outlet, the process fluid having an inlet pressure at the inlet and having an outlet pressure at the outlet, the multiphase pump comprising:

a liquid reservoir configured to retain process liquid extracted from the process fluid as it flows through the multiphase pump, and to communicate the retained process liquid to a suction chamber of the multiphase pump during gas slugs, said suction chamber being a region within the multiphase pump where a pressure of the process fluid is substantially equal to the inlet pressure, the liquid reservoir being configured to retain said process liquid during said gas slugs, thereby ensuring that a gas seal is maintained within the pump; and a cooling loop in thermal communication with the process liquid in the liquid reservoir and configured to remove heat from the process liquid in the liquid reservoir by extracting a cooling liquid directly from within the liquid reservoir into the cooling loop and circulating the cooling liquid from the liquid reservoir to a cooling apparatus that is exterior to the liquid reservoir, and from the cooling apparatus back to the multiphase pump, the cooling loop being configured to circulate the cooling liquid during and throughout said gas slugs.

2. The multiphase pump of claim 1, wherein the cooling liquid circulated through the cooling loop is process liquid extracted directly from the liquid reservoir.

3. The multiphase pump of claim 2, wherein a liquid outlet of the cooling loop is located in a region of the multiphase pump that is at a pressure lower than a pressure of the process liquid retained in the liquid reservoir, so that a pressure difference between the cooling loop outlet and a cooling loop inlet causes the process liquid to flow through the cooling loop.

4. The multiphase pump of claim 1, wherein the cooling loop includes a heat exchanger contained within the reservoir and configured to exchange heat between the process liquid retained in the liquid reservoir and the cooling liquid circulated through the cooling loop.

5. The multiphase pump of claim 1, wherein the cooling loop further includes a cooling pump configured to circulate the cooling liquid through the cooling loop.

6. The multiphase pump of claim 1, wherein the cooling loop further includes a cooling liquid pressure control valve.

7. The multiphase pump of claim 1, wherein the cooling apparatus is a heat exchanger.

8. The multiphase pump of claim 1, wherein the multiphase pump is a twin screw pump.

9. The multiphase pump of claim 1, wherein the liquid reservoir is a chamber formed between an outer casing of the multiphase pump and an inner casing of the multiphase pump.

10. The multiphase pump of claim 1, wherein the liquid reservoir is configured to retain liquid from the process fluid by functioning as a liquid trap that captures process liquid from the process fluid as the process fluid flows through the multiphase pump.

* * * * *